United States Patent [19]

Merjan

[11] 4,132,082

[45] Jan. 2, 1979

[54] PILING

[76] Inventor: Stanley Merjan, 16 Beacon Dr., Port Washington, N.Y. 11050

[21] Appl. No.: 745,405

[22] Filed: Nov. 26, 1976

Related U.S. Application Data

[60] Division of Ser. No. 601,728, May 4, 1975, abandoned, which is a division of Ser. No. 303,706, Nov. 6, 1972, Pat. No. 3,913,337, which is a continuation-in-part of Ser. No. 256,165, May 23, 1972, Pat. No. 3,875,752, which is a continuation-in-part of Ser. No. 235,790, Mar. 17, 1972, Pat. No. 3,751,931, which is a continuation-in-part of Ser. No. 97,997, Dec. 4, 1970, abandoned.

[51] Int. Cl.[2] ..... E02D 5/30

[52] U.S. Cl. ..... 405/253; 405/244; 52/170

[58] Field of Search ..... 61/53, 53.52, 53.6, 61/53.62, 56, 56.5, 53.64, 53.66, 53.7; 175/21; 52/170, 297, 298

[56] References Cited

U.S. PATENT DOCUMENTS

| | | | |
|---|---|---|---|
| 1,778,925 | 10/1930 | Thornley | 61/53.52 |
| 2,065,507 | 12/1936 | Alexander | 61/56 |
| 2,187,318 | 1/1940 | Grevlich | 61/56 |
| 3,751,931 | 8/1973 | Merjan | 61/53 |

*Primary Examiner*—Jacob Shapiro
*Attorney, Agent, or Firm*—Abner Sheffer

[57] ABSTRACT

A concrete pile fitted with a special slightly tapered concrete tip of larger area. The tip has a central open socket for receiving concrete poured in after the pile is in place.

5 Claims, 22 Drawing Figures

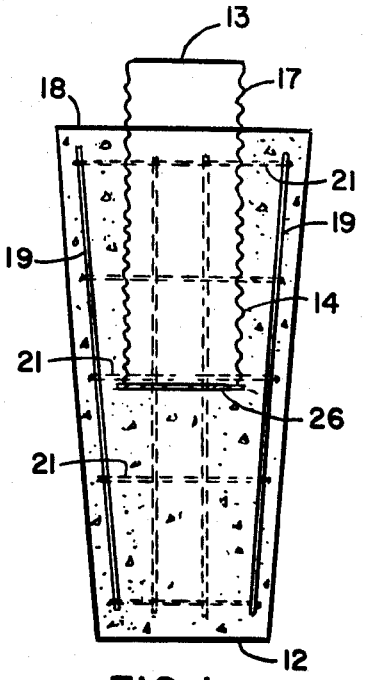
FIG. 1
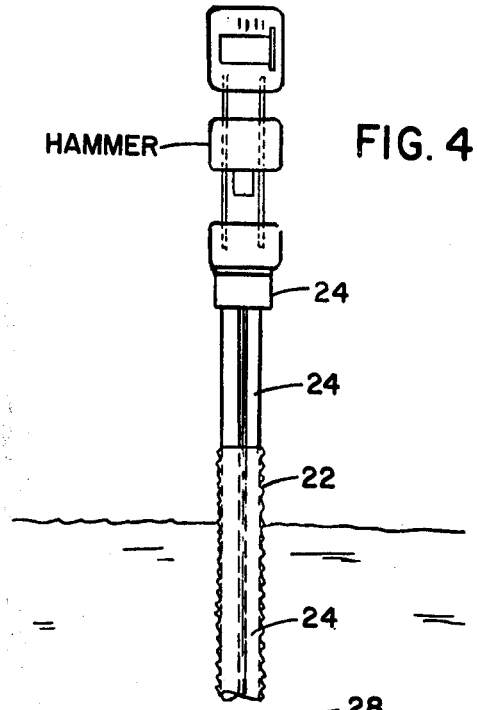
FIG. 4
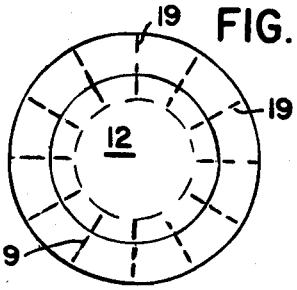
FIG. 2
FIG. 3
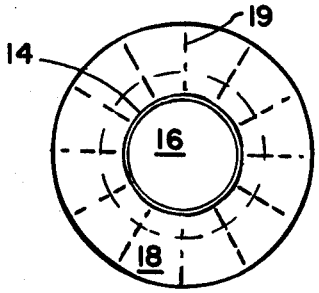
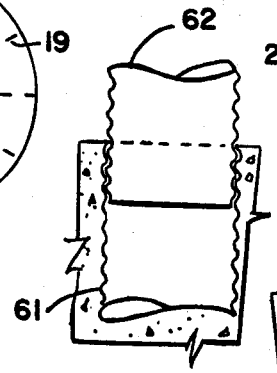
FIG. 11
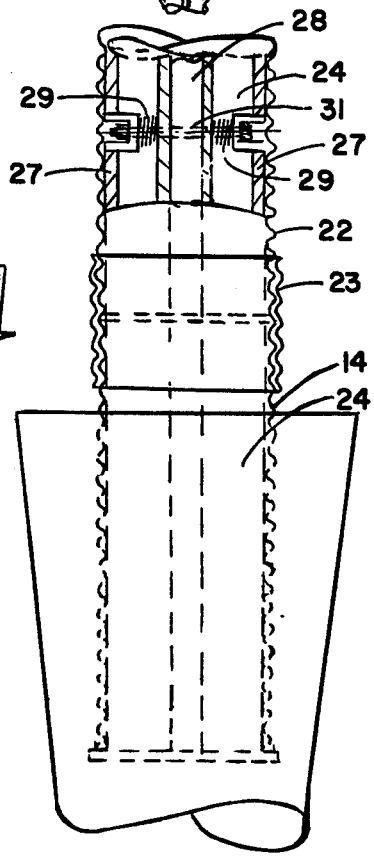

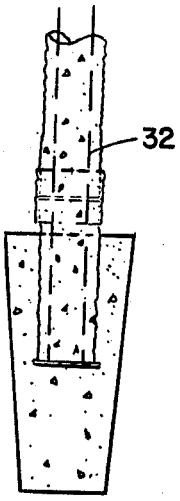
FIG. 5
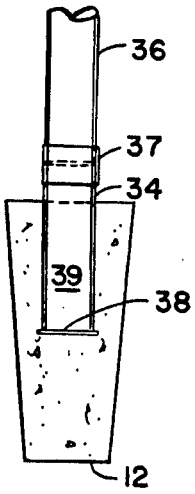
FIG. 6
FIG. 9
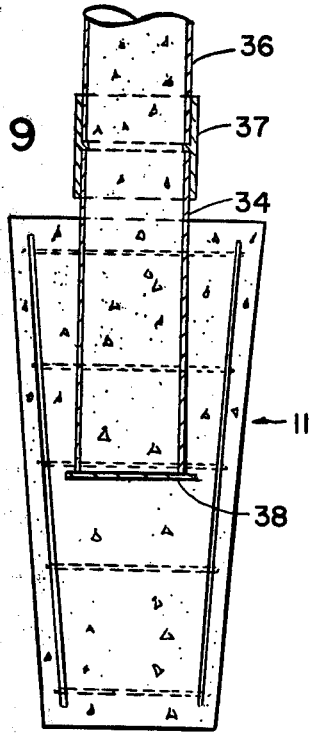
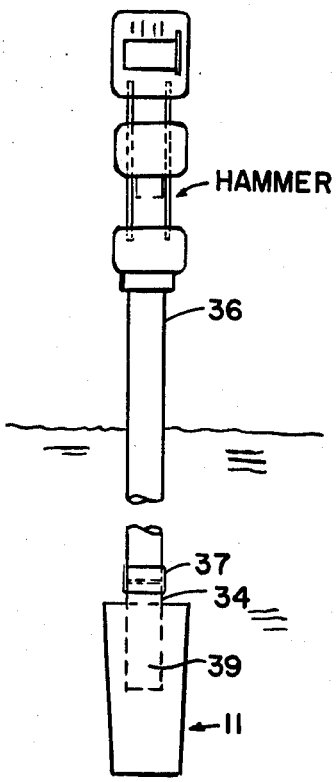
FIG. 7
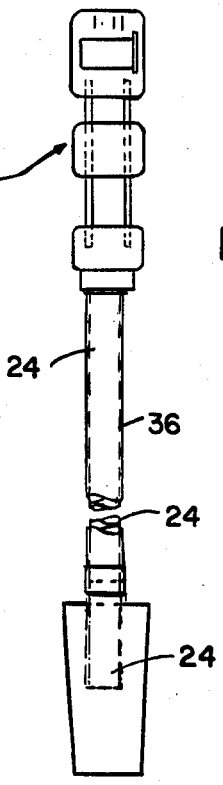
FIG. 8
FIG. 10
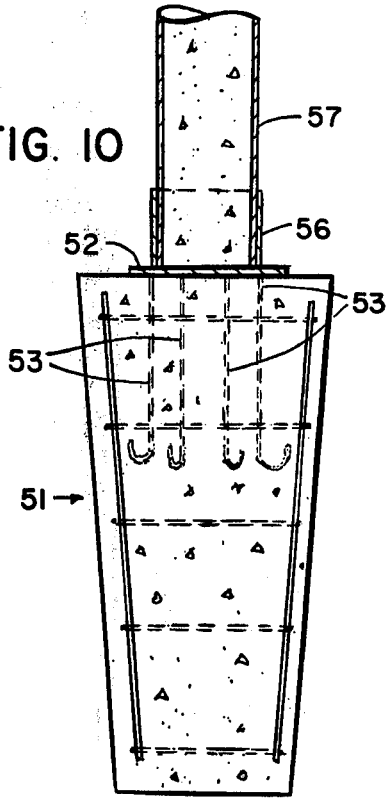

FIG. 16
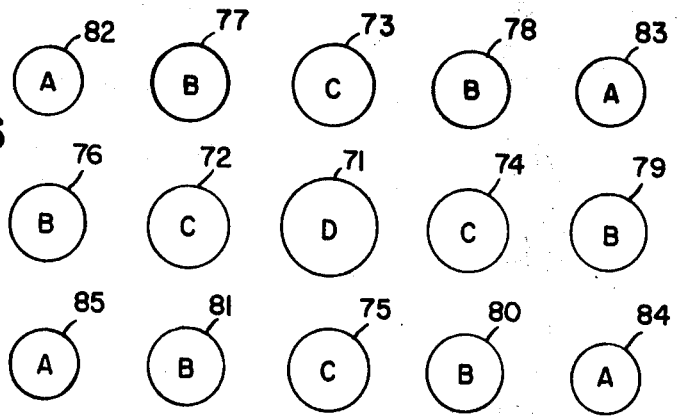
FIG. 17
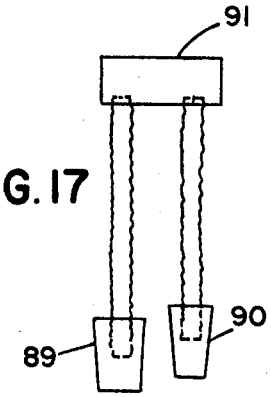
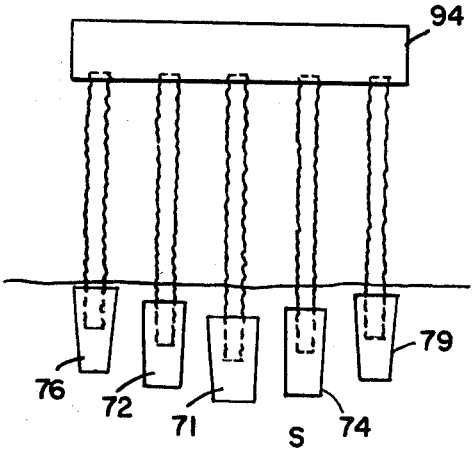
FIG. 18
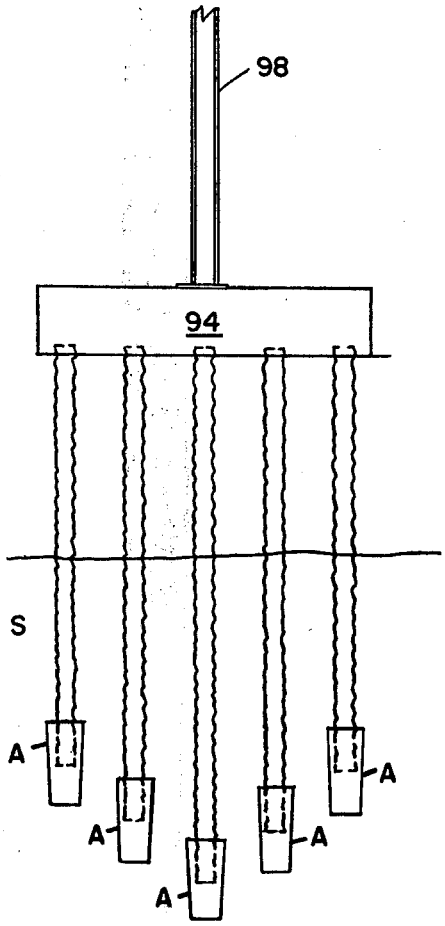
FIG. 19

PILING

This is a divisional, of application Ser. No. 601,728 filed May 4, 1975 and now abandoned, which is a divisional of application Ser. No. 303,706 filed Nov. 6, 1972 now Pat. Ser. No. 3,913,337 which is a continuation-in-part of Ser. No. 256,163 filed May 23, 1972 now U.S. Pat. No. 3,875,752 and which is a continuation-in-part of Ser. No. 235,790 filed Mar. 17, 1972 now U.S. Pat. No. 3,751,931, which is a continuation-in-part of application Ser. No. 97,997 filed Dec. 4, 1970 abandoned.

This invention relates to piling.

In present commercial practice, when bedrock is at a reasonable depth, high-capacity H pile steel sections, open end or closed end pipe can be driven economically to capacities in excess of 100 tons. Compact sands and stiff clays will generally support H pile, steel pipe, mandrel-driven shell type piles, or pre-cast concrete pipe piles for capacities in excess of 50 tons and these piles are economical when the lengths are moderate.

However, there are situations where the soil conditions will not conveniently accommodate these specific piling types. For example along, and near, the sandy ocean beaches there are often great depths of relatively loose cohesionless materials. Here conventional piles must penetrate considerable distances to develop acceptable capacities by friction forces between the pile surface and the soil. In another situation, a thin layer of the relatively loose cohesionless material usually situated underneath a non-bearing layer of silt, clay or fill or mixtures thereof) overlays a deep stratum of soil of very low bearing capacity such as soft clay. Here, when the pile is driven through the layer of loose material it must then be driven through the deep clayey layer to an acceptable bearing layer below the clay.

The piles of this invention are particularly suitable for use in supporting heavy loads on land in which the bearing soil is comparatively loose and granular, and not capable of sustaining high unit loads (e.g. soil of "N" value less than 30, say about 5 to 10) which soil may be situated below a relatively thick layer of soil unsuitable for bearing such as a fill or soft clay. In such cases it has been proposed to use a Franki type of pile, in which a mushroom base of concrete is pushed out at the bottom of the pile after the pile has been driven down to the bearing layer. Such piles are described at, for instance, pages 250–251 of the book "Pile Foundations Theory-Design-Practice" by Robert D. Chellis, published 1951 by McGraw-Hill, which also discusses a great many other types of piles known to the art. As pointed out by Chellis the Franki piles "are of particular advantage where a bearing stratum, of limited thickness only, can be reached within economical depths". While such Franki piles have, in many cases, large capacities (e.g. 120 tons per pile), their installation is quite complicated and very expensive; special costly equipment is needed and conventional automated pile-driving techniques cannot ordinarily be used. In addition the character of any individual driven pile is not readily predictable; I believe that this may be due, for instance, to eccentricities in the shape of the mushroom base of concrete that is rammed out of the bottom of the pile, and other factors.

Among the other piles which are in present commercial use in the loose soil conditions are the Raymond piles described on pages 233–235 of the Chellis book and the Monotube composite tapered pile which typically has a fluted heavy gauge shell which tapers down at its base. Where the loose granular soil layer is of limited thickness such piles tend to penetrate through that layer without attaining high capacities and must then be driven to considerable depths; even then the capacities do not approach those attainable using the piles of the present invention.

In accordance with one aspect of this invention there is provided a much less expensive pile, which can be installed economically with conventional automated techniques and which has high load bearing capacity in the soil conditions described above. Although the rated load bearing capacity of my new pile may be below that of a properly installed Franki pile, it is much higher than that of other conventional piles. The economy of installation makes it practical to overcome this lower bearing capacity by driving more of my new piles, so that the total cost for properly supporting a given building or other structure will be considerably lower when my new piles are used than when Franki piles are employed. The construction of my new pile is such that it can be driven rapidly, accurately, and easily, with good rigidity and stability of direction, by conventional automated pile driving hammers at high impact frequencies (e.g. 50 to 120 blows per minute using conventional hammers such as described at pages 70–72 of the Chellis book, the pile driving energy usually being in the range of about 15,000 – 36,000 foot pounds per blow).

Certain preferred forms of the invention are illustrated in the accompanying drawings in which FIG. 1 is a cross-sectional view, to scale, of one preferred type of pile tip in accordance with this invention.

FIG. 2 is a bottom view of the pile tip of FIG. 1.

FIG. 3 is a top view of the pile tip of FIG. 1.

FIG. 4 is a side view, also in cross-section, showing the pile tip of FIG. 1 connected to the stem of the pile and showing the pile being driven into the ground with a removable mandrel housed in a socket in the pile tip.

FIG. 5 is a side view, also in cross section, of a portion of the tip and the lower portion of the pile stem after concrete has been poured into the stem.

FIG. 6 is a cross-sectional view, to scale, of another form of pile tip in accordance with this invention, showing the pile tip connected to the tubular stem of the pile.

FIG. 7 illustrates schematically one way of driving the pile shown in FIG. 6.

FIG. 8 illustrates schematically another way of driving the pile shown in FIG. 6.

FIG. 9 is a side view, in cross section, of a portion of the tip of FIG. 6 and the lower portion of the pile stem after concrete has been poured into the stem.

FIG. 10 illustrates the use of a pile tip without a socket,

Figure 12:
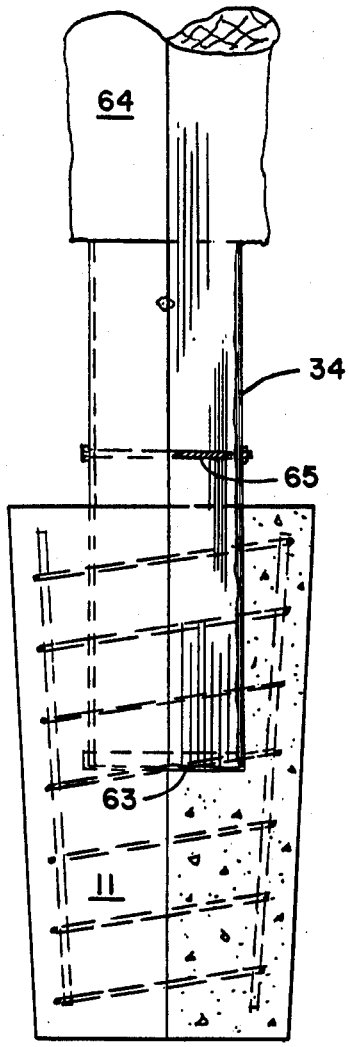
Figure 14:
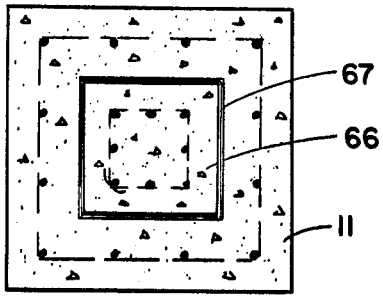
Figure 13:
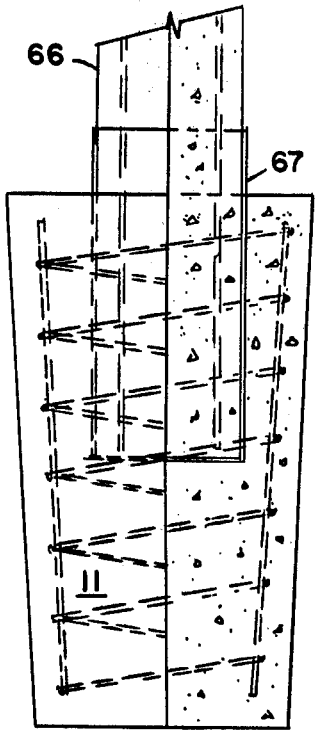
Figure 15:
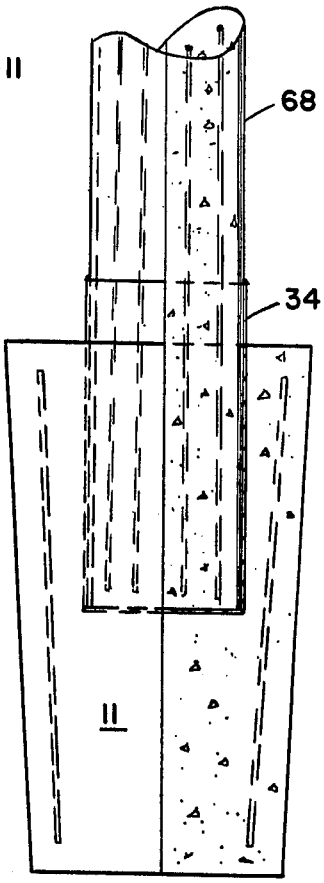

FIG. 11 shows the use of a sleeve instead of a projecting stub for lining the socket, FIGS. 12–15 illustrate the use of the tip with shafts or stems which are driven without a mandrel, specifically a wood stem (FIG. 12), a pre-cast pile stem (FIGS. 13 and 14) or a pipe pre-filled with concrete (FIG. 15). FIGS. 12 13 and 15 are views of the lower end of the pile, including the tip, in elevation partly in cross section, and FIG. 14 is a horizontal cross section through the upper portion of the tip of FIG. 13.

FIGS. 16–19 illustrate the use of tips of different sizes in the driving of groups of pile. FIG. 16 is a plain view of an arrangement of piles. FIG. 17 is a view in elevation showing two piles joined by a pile cap. FIG. 18 is an elevation taken through the pile cap and middle rows of piles in FIG. 16. FIG. 19 is an elevation as in FIG. 18 but showing relative penetrations if all tips were of one size.

Figure 20:
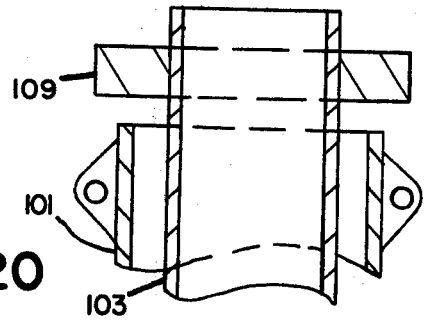
Figure 21:
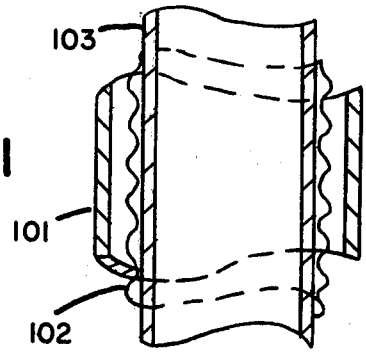
Figure 22:
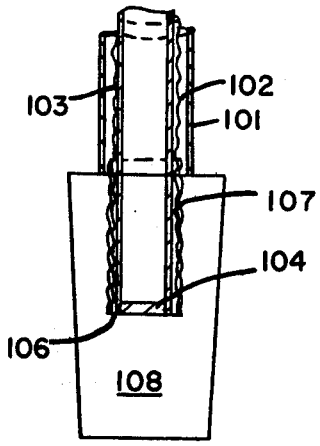

FIGS. 20–22 illustrate an arrangement using a protective sleeve shield. These views are all cross-sections, in elevation, broken away, taken a different levels.

Turning now to FIG. 1 the tip 11 is of reinforced concrete of symmetrically tapered frusto-conical construction with its base 12 being substantially flat (and in a plane substantially perpendicular to the axis 13 of the tip). The taper is gradual; in FIG. 1 it is about ½ inch per foot. The concrete tip is formed by casting in place around a relatively short length or stub of threaded (corrugated) steel shell 14 of conventional type leaving a substantially cylindrical central open socket 16 in the upper part of the concrete of the tip, and with a portion 17 of the stub projecting above the substantially flat top surface 18 of the concrete tip. It will be understood that the stub may be made of other metals or of other suitable materials, such as materials which, like metals, have a considerably higher tensile strength than concrete such as organic plastics (e.g. polycarbonate, such as "Lexan" or oxymethylene polymers such as "Celcon").

In FIG. 1 the reinforcement of the concrete is constituted by a series of equally spaced axially oriented reinforcing bars 19 disposed around the socket 16 and extending below the level of the base of the socket, the bars 19 being tied together by transverse reinforcing rods or bars 21 secured to bars 19 as by suitable means, e.g. wires tied around the bars. Instead of, or in addition to, reinforcing rods, the concrete may contain pieces of sheet metal distributed therethrough, or it may contain fibrous reinforcement (e.g. fibers of high tensile strength such as steel fibers of say 1/10 inch diameter, 1 to 2 inches long, occupying a small portion, such as 2%, of the total volume of the concrete).

In use, the tip 11 is connected to the stem 22 (FIG. 4) of the pile by a suitable connection, such as a threaded adapter 23, also of conventional shell construction, engaging both the projecting portion of the stub 14 and said stem. A mandrel 24 is disposed within the socket 16 (e.g. resting on a steel plate or boot which forms the base 26 of the socket; this plate preferably has a larger diameter than that of the stub and is put in place before the concrete of the tip is cast) for receiving the blow of the pile-driving hammer and transmitting its downward force to the concrete tip. The particular conventional mandrel shown in FIG. 4 extends the whole length of the stem. In FIG. 4 the upper portion is shown on a reduced scale and part of the lower portion is broken away to show details of the mandrel.

It will be apparent that the illustrated tip will stand stably in straight vertical position on its substantially flat base and can thus be placed straight up at the precise location where the pile is to be driven, remaining straight up at that location while the stem is attached and the mandrel is introduced, without the need for special support.

As the pile is driven, the tip penetrates through the non-bearing soil, until it reaches the bearing soil. Continued driving forces it into the latter, generally until the resistance to the driving force indicates that there is adequate load bearing capacity (e.g. using standard piledriving formulas which relate load-bearing capacity to driving resistance and/or using actual static load tests in which the pile is loaded with twice the load it is expected to carry and the movement of the pile under such loading is measured, a movement of about one inch or less in this test generally being an indication that the pile will be satisfactory to carry the expected load).

The mandrel 24 may be of conventional construction. For instance it may be of the type having a pair of almost hemicylindrical halves 27 which, in use, are pressed apart against the internal walls of the shell (in this case, including the section of shell lining the socket 16). To this end there is an inflatable element 28 to which air (or other fluid) is admitted under pressure so as to expand the element 28 against the inwardly facing walls of the mandrel halves 27. When the mandrel is to be removed from the socket, the pressure in the inflatable element is reduced and the mandrel halves move together, away from the walls of the shell, under the influence of springs 29 mounted on rods 31 which pass through the mandrel halves; one end of each spring engages a wall of a mandrel half 27 while the other end is held at the outer end of its rod.

Another conventional type of mandrel which may be used is simply a heavy pipe extending through the stem and into the socket and resting on the base of the socket. For instance when the stem and socket each have an internal diameter of 13 inches, the mandrel may be a 12¾ inch outside diameter heavy-walled pipe which is driven by the hammer and transmits the driving force to the base 26 of the socket.

After removal of the mandrel, the shell (including the stub and the main stem of the pile) is filled with concrete. As shown in FIG. 5 the concrete fills the socket, making for an excellent connection between tip and stem so that they behave more as an integral unit even in response to tension forces. If desired, reinforcement, such as reinforcing rods 32, may be placed so as to extend from the cavity up into the stem before the concrete is poured.

In the tip illustrated in FIGS. 6 to 9 the stub 34 is a short piece of pipe, e.g. straight-sided steel pipe having a diameter of about 8 to 14, or even 18, inches and having a wall thickness of about 0.17 to 0.4 inch or more; the tubular material conventionally used for pipe piles may be used. It is adapted to be joined to the stem 36 of a pipe pile by a connector, such as an internally tapered sleeve 37 whose internal diameter is about the same as the external diameter of the stub and stem, there being a drive fit between the sleeve 37 and the top of the stub and between the sleeve and the bottom of the stem; this connection may be formed by welding if desired. To assist in anchoring the stub in the concrete of the tip the stub of FIG. 6 may have welded to its base a flat transverse plate 38 of larger area than the cross-sectional area of the stub. This plate (e.g. of ½ inch thick steel) may be welded to the stub before the concrete of the tip is cast. The pile may be driven by pile-driving hammer blows at the top of the stem (FIG. 7) or, particularly when a thin-walled stem is used which stem may even be of corrugated construction), it may be driven by such blows applied to an internal mandrel 24 (FIG. 8) in the socket 39 formed inside the stub 34. The plate 38 also helps to distribute the vertical pile driving forces more uniformly through the concrete tip. When the concrete is poured into the stem 36 it fills the socket 39, as shown in FIG. 9; here again reinforcement may be placed so as to extend from the cavity up into the stem.

The particular tips shown in the drawing are designed for use with a stem having a diameter of about 12 inches (for the embodiment of FIG. 6) or 14 inches (for the embodiment of FIG. 1). The base 12 of the tip has a diameter of about 24 inches, which is considerably larger than that of the stem. The maximum diameter of the tip, at the top, is about 30 inches and the axial height of the tip, measured from its base to the level at which its diameter attains its maximum, is about 60 inches, so that its taper is about 3/5 inch per foot.

In general, tips of this invention may be used with stems of about 8 to 18 inch diameter. The tip is preferably circular in cross section (although other cross-sections adapted to give a substantially uniform load distribution around the pile, e.g. square cross section, may be employed) and its projected area (at its maximum diameter) is above twice, and preferably about 5 to 15 times, the cross-sectional area of the stem. Preferably the base of the tip has a diameter of a least 8 inches, although the use of tips having differently shaped bases, e.g. pointed tips, is also within the broader scope of this invention. Preferably the axial height of the tip is at least two feet and at least 1 foot greater than the depth of the socket but less than ½, more usually less than ⅓, of the overall height of the pile (including the stem). The taper is generally less than 3 inches per foot (and preferably less than 1½ inches per foot) and above ¼ inch per foot (but it is within the broader scope of the invention to use an untapered tip). The depth of the socket is generally within the range of 1/10 to 9/10 of the axial height of the tip, preferably at least 3/10 and less than 7/10 of that height, more preferably about 0.4 to 0.6 times the height of the tip.

The use of the tip of this invention enables one to use shorter lengths of pile for a given load bearing capacity. Generally the overall length of the pile (including tip) will be in the range of about 10 to 50 feet or more.

The ground-engaging surfaces of the concrete tip may be smooth or textured (e.g. corrugated).

The "N" value, previously mentioned, is a conventional reference for soil compactness. It is the number of blows of a 140 lb. hammer, dropped from a height of 30 inches, required to advance a standard 2 inch dimeter split spoon sampling tube a distance of 12 inches.

When the tip is driven through certain non-bearing soils, the soil does not flow back around the stem above the tip and there is an unfilled space around the stem. This space is preferably filled in, from the top, by dumping or otherwise placing material such as sand which may be applied dry or with water (e.g. it may be puddled or jetted in).

It is within the broader scope of this invention to drive piles having the tips of this invention into a bearing layer of soft rock. They may be driven, for instance, into a stratum of oolite, a porous limestone formation found, for instance, on the east coast of the state of Florida.

It is also within the broader scope of the invention to use a pile tip without a socket. For instance, as illustrated in FIG. 10 the tip 51 may have an upper plate 52, to which are welded downwardly extending reinforcing rods 53 (or other suitable anchoring means) around which the concrete 54 of the tip is cast, with the concrete being in contact with the lower face of the plate 52. A stub 56 (which may be a short length of pipe of the type used in the embodiment shown in FIG. 6) is welded to the top of the plate (either before or after the concrete of the tip is cast) to provide an attachment to the stem 57 of the pile. After driving the stem and stub are filled with concrete, as previously described.

While the tip of this invention is particularly suitable for use when attached to the longer stem of a pile, it is also within the broader scope of this invention to use the tip with a very short stem, or without any stem at all, as in situations in which piles or other driven elements have not been previously employed. For example, when the bearing soil (e.g. a fine to medium sand of "N" value about 8 to 10) is at, or very near, the surface and is not overlaid by other non-bearing strata of significant thickness, the tip itself (without a stem) may be driven directly into the surface, e.g. the tip illustrated in FIG. 1 may be driven some 6 feet into the soil by means of a conventional pile driving hammer operating on a mandrel within the socket of the tip. A spaced series of such driven tips (the axes of adjacent tips being spaced apart by a distance equal to say about 1½ times the largest diameter of the tip) can support a heavy building or other structure without the need for extensive excavation and without the need for large footings or mat foundations.

Instead of using a projecting stub for lining the socket of the concrete tip, one may employ a sleeve which does not project above the top of the concrete tip and which is adapted to be connected to the stem of the pile. In one suitable construction, illustrated in FIG. 11, this sleeve 61 is made of corrugated shell material of slightly larger diameter than the shell material of the pile stem 62 so that, after the tip has been fabricated and is ready for use, the stem can be attached to the tip by screwing it into the sleeve 61. The stem can also be attached by screwing it directly into an otherwise unlined socket having integral concrete threads adapted to engage the lower end of the stem directly without an intervening liner; in this case, the concrete is cast around a suitable form (which may have the same configuration as the stub or sleeve, previously mentioned) and that form is removed after casting of the tip, leaving an internally threaded concrete-surfaced socket into which the stem is screwed before the pile is driven. Alternatively the unlined socket may be unthreaded but adapted to be frictionally connected to the stem; thus the socket may have straight slightly tapered walls (defining, for instance, a frustum of a downwardly pointed cone) and the lower end of the stem (which may be correspondingly tapered) may be pushed into the socket so that there is a force fit between stem and socket. On the lower end of the stem may be bonded to the inner walls of the unlined socket by means of a suitable cement. The stem can also be attached by screwing it into a lined socket, whose liner is of slightly larger diameter than that of the stem. It will be seen that in these cases the lower end of the stem serves also as all or part of the liner of the socket.

The present invention makes it possible for relatively large volumes of concrete, comparable to the volumes of extruded material in Franki piles, to be more economically put in place in deeper strata and with more uniform results. As with the Franki piles, the piles of the present invention give their results largely by the compaction of the soil of low bearing value and they attain very high load bearing capacity in relatively shallow strata. Typical examples of such conditions are as follows: (a) 18 feet of miscellaneous fill and gray clayey organic silt overlying a 15 foot thick layer (of N value about 25) of fine silty said (containing some medium gravel) overlying more than 50 feet of clay; (b) 15 feet of miscellaneous fill, peat and gray silt overlying a 10 foot thick layer of medium to fine loose sand (N value about 12) overlying another 50 feet of red brown silty fine sand; (c) 10 to 15 feet of fill overlying 1 to 4 feet of peat and an underlying layer of loose sand of N value 6 to 30.

The present invention also makes it possible to drive the pile accurately in the desired direction. One factor in this is the presence, during driving, of the rigid mandrel within the socket which helps to insure that the tip does not become deflected by localized variation in soil resistance, e.g. boulders, debris, uneven strata, etc. Any appreciable deflection tendency will cause a portion of the inner wall of the socket to press hard against the corresponding outer wall of the sturdy rigid mandrel which will resist such deflection.

The particular tip size can of course be adjusted in accordance with the desired load bearing capacity. Thus as between (a) a tip having a height of 34 inches, and diameters of 20 inches at its base, and 24 inches at the top on a 10¾ inch diameter stem and (b) a tip having a height of 60 inches, and diameters of 23 inches at its base and 29 inches at the top, on a 12¾ inch diameter stem, the load bearing capacity was higher for the larger tip but the small tip is more economical to fabricate and drive.

The piles of this invention are easily inspected and tested. Thus, if the tip should be seriously defective (e.g. cracked) this can be readily detected since driving characteristics of the pile will be as if there were no tip. The stem of the driven pile can be readily inspected by visual methods before the concrete is poured into it.

The tips of this invention may also be used with various shafts or stems in pile constructions which are driven directly without the use of a mandrel.

More particularly, FIG. 12 illustrates the use of a length of wood pile as the stem; FIGS. 13 and 14 show the use of a precast pile as the stem, (FIG. 14 being a horizontal cross section through the upper portion of the tip); while FIG. 15 shows the use, as a stem, of a pipe prefilled with concrete.

The arrangement shown in FIG. 12 is suitable for relatively light pile loadings (15 tons to 30 tons). Tip 11 has a stub 34 which is, as in FIGS. 6 to 9, a short piece of pipe (e.g. steel pipe of, say, about 8 inch outside diameter and 3/16 inch wall thickness). To keep concrete out of the socket during the casting of the tip there is a barrier 63 which may be of any suitable materia; conveniently it is a pipe cap of light gauge metal which is force-fitted to the bottom of stub 34 before the casting operation. A length of ordinary wood piling 64 is driven so that its lower end fits tightly in the socket. (The lower end is preferably first trimmed to roughly the same cross-section as the cross-section of the socket but slightly larger than the socket so that the wood is compressed somewhat during this initial driving, which aids in making a tight fit). Driving may be effected, for instance, by placing the tip, socket upwards, on the ground at the point where the pile is to be driven, positioning the wood stem 64 above the socket, and then driving the latter into the socket with the pile driving hammer; the wood stem may then be secured in place by any suitable means, such as bolts and nuts 65. A pile of this type may be driven with a lower-energy pile hammer (e.g. of energy about 7000 to 19,500 ft. lbs. per blow) and is capable of producing required driving resistances in soils substantially looser than would be the case for a wood pile driven without the tip 11. As compared to ordinary wood piles the invention provides higher load capacities and/or shorter piles in soils which are generally loose and granular. Typically, for this use the tip has a height of about 2½ feet, and diameters of about 17 inches (at the base) and 20 inches (at the top), the stub 34 being about 30 inches long, half of which is within the concrete. The wood pile stem may be, for instance, about 10 to 90 feet long.

In FIG. 13 there is employed precast reinforced concrete pile stem 66. Such stems are available (see page 200–206 of the Chellis book, for instance) in various cross sections, most commonly square as illustrated (see FIG. 14) although other cross sections, such as hexagonal, octagonal or circular may be used. Element 67 may be a cup-chaped piece (or assemblage) of light material, such as sheet metal, which serves as a form to define the cavity or socket at the top of the tip during the casting of the tip. Preferably it is tapered slightly (being wider at the top) and the lower end of the concrete stem 66 may be similarly tapered so that the pile may be assembled simply by driving the stem into the cavity and thereby wedging the lower end of the stem in said cavity. One may also remove all or part of the element 67 after the tip is cast and hardened; thus when the pile is assembled the concrete surface of the lower end of the stem may be in contact with the concrete inner surface of the cavity of the tip. (It will be understood that, similarly, when a wood stem is used, the cavity of the tip need not have a liner, e.g. one may omit the stub 34, and thus force the wood into contact with the concrete, in FIG. 12). Piles of this type may be constructed, for instance, in sizes suitable to produce bearing capacities of, say, from about 30 to 100 tons or more when driven with hammers whose energies may range from, say about 15,000 to 36,000 ft. lbs. or more per blow. In a typical pile of this construction the stem is about 14 inches square, the tip has a height of about 3 feet and is about 2 feet square at the top and about 20 inches square at the bottom.

In FIG. 15 the stem 68 is a pipe that has been filled with concrete, which is poured into the pipe (containing spaced reinforcing wires or bars as indicated) and hardened there, before the stem is fitted to the tip. This arrangement offers a very rigid driving medium with the economy of the pre-poured pile stem; it may be used, for instance, in a range of capacities from, say, about 25 to 100 tons or more, when driven with hammers whose energies would be, for instance, about 19,000 to 30,000 ft. lbs. per blow. The pipe of the stem may be heavy-walled steel pipe having an external diameter such that there will be a close slip fit between said pipe and the inner wall of stub 34. To provide uplift capability for the pile, if desired, the stem may be welded to the stub 34 as indicated by the fillet at the top of stub 34 in FIG. 15.

Piles are frequently employed in groups, with anywhere from 2 to say, 20 piles joined by a "pile cap" on which the load (such as a column of a building) is supported. Usually the vertical axes of the piles of a group are spaced about 2½ to 6 feet apart depending on the sizes of the piles. The pile cap is designed so that the load is substantially evenly distributed over all the piles of the group; often it is a reinforced concrete structure of suitable stiffness to accomplish this, so that all the piles act in unison.

In one aspect of this invention, the piles of such a group have tips of different volumes, or displacements, with the larger tip being driven before the smaller tip. The use of this procedure results in significant reductions in costs, saving both time and material. Preferably the larger tip has a displacement more than 5% greater than the smaller tip, e.g. 10% or 20% greater.

For illustrative purposes, certain specific tips of different sizes will be referred to hereafter by the letters A,B,C,D,E; these letters are also used in the drawings to designate piles having the corresponding tip. Each such tip has generally the configuration of the tip shown in FIG. 1, and is six feet high. The following tabulation lists the diameter (in inches) of the top and bottom of each tip: A 29,23; B 32,26; C 35,29; D 38,32; E 41,35. For each of these tips the diameter of the stem, and of the socket of the tip, is about 16 inches so that the stem (after filling with concrete) can safely carry a 100 ton design load and transmit it, without failure, to the tip.

At one location it was determined by tests that for the underlying sand bearing stratum (having an "N" value of about 8 and situated below a 20 foot thick non-bearing layer of fill), a pile having an "A" tip would have a acceptable design capacity of about 100 tons when driven in a predetermined manner with a Vulcan "O" hammer (on a mandrel which is a heavy piper extending through the stem into the socket and resting on the base of the socket) until the driving resistance was such that 8 to 10 blows of the hammer were needed to move the pile downward 1 inch. In the test of the "A"-tip pile, the pile driven 20 feet into the bearing stratum (i.e. the pile was driven 40 feet into the ground and the length of stem in the ground was 34 feet) before this resistance criterion of 8 to 10 blows per inch was attained. The acceptable design capacity of 100 tons means that the pile will pass a standard N.Y. City 1968 building code load test with a 200 ton load on the driven pile; in this test the test pile is loaded in increments, until the load thereon is 200 tons, and the settlement of the pile under load is measured; under the 200 ton load the settlement must be less than ¾ inch and, during a subsequent 96 hour period under the 200 ton load, there must be no further measurable settlement After the resistance criterion of 8 to 10 blows per inch to given a 100 ton acceptable design capacity was confirmed by appropriate load testing, a group of three piles was driven. The axis of each pile was 4½ feet from the axis of the other two; thus, the axes formed the apices of an equilateral triangle whose sides were each 4½ feet long. The first pile to be driven had a "C" tip. With this pile, having the larger tip, the resistance criterion was attained, and driving was stopped, after the pile had penetrated only 8 feet into the bearing stratum. The next two piles to be driven had "A" tips. It was found that with each of these piles the resistance criterion was attained (and driving was stopped) after the piles had penetrated only 6 feet into the bearing stratum. Thus by first driving a pile having a larger tip and then two piles having smaller tips the desired bearing capacity was attained with much shorter pile stems (20 feet as compared to 34 feet). This represents a considerable saving in cost. Also all the tips were at about the same level in the same stratum, which is desirable because all tips are in a continuous zone of compaction. Furthermore, the total number of blows (and the time) required for driving the group of three piles was less than if all piles had A tips. I believe that the use of a larger tip for the initial pile of the group acts to compact the soil for a considerable distance (measured horizontally) around the tip, making it better able to support the subsequently driven piles.

FIG. 16 is a plan view illustrating an arrangement of piles in a group of 15 covering a rectangular area, the spacings between the center lines of the piles being equal along the major axes. In this arrangement the central pile 71 having a "D" tip is driven first. After that piles 72, 73, 74, 75 having "C" tips are driven symmetrically about the central pile, and then piles 76, 77, 78, 79, 80 and 81, having "B" tips, and finally piles 82, 83, 84 and 85, having "A" tips, are driven in a symmetrical arrangement, with the centerline spacings along the major axes being equal and in the range of, say, about 4½ to 6 feet.

FIG. 17 is a view in elevation illustrating an arrangement in which there are only two piles 89, 90 joined by a pile cap 91. The pile 89 having the larger tip is driven first. The cap is of course emplaced after the piles have been driven.

FIG. 18 is an elevation taken through pile cap 94 and the middle rows of piles in FIG. 16 showing the pile penetrations below the top of bearing strata S.

FIG. 19 is an elevation as in FIG. 18, but showing the relative penetrations of the piles if all tips were "A" tips. The central pile in this, driven first, would then penetrate deeper than the corresponding central pile 71 in FIG. 17, having a "D" tip. Subsequent piles having "A" tips would penetrate less with a likelihood that differences in penetration would be greater than those shown for FIG. 18 unless these piles are overdriven (at considerable expense due to the resistances involved). In the case of FIG. 18 densification of the bearing strata S starts to take place upon penetration of the tip into that bearing strata and resistance is quickly generated to the large tip pile 71. Subsequent piles with smaller tips benefit from this densification and these will meet adequate resistance at or slightly above the penetration of pile 71. However, in FIG. 19, the initially driven central pile must penetrate deeply enough into the bearing strata where the soil in its undisturbed state has a degree of compaction sufficient to produce adequate driving resistance. Subsequent piles with the same tip size will meet the required resistance at the higher elevations shown because of densification caused by the previously driven piles. In general it is desirable that all tips of a group of piles joined by a single cap, be driven to such levels that a single horizontal plane will intersect all the tips, albeit at different levels of the several tips; for instance, if all the tips are 6 feet in height the difference in elevations of any two tips of the group is advantageously no more than about 6 feet. FIG. 19 also shows a column 98 supported by the pile cap.

It is preferable that the horizontal spacing between the axes of any two adjacent tips be sufficient to reduce the possibility of interference between the adjacent outer shoulders of such tips; to this end it is preferable that the horizontal distance between these axes be well over a foot greater (and preferably at least 18 inches greater; e.g. 22 inches greater) than the sum of the maximum radii (i.e. the radii at their widest portions) of the two tips.

While the aspect of the invention in which tips of different sizes are employed finds its greatest utility when the tips have a socketed construction as described earlier in this specification, it may also be used with piles having tapered tips generally.

FIGS. 20–22 illustrate an embodiment which is intended for use with piles having enlarged tips, such as those described above, when their stems are of such construction, (e.g. a conventional threaded [corrugated] steel sheel) and of such length (e.g. 40–50 feet or more) that the friction between the stem and the surrounding soil may become so large as to strain the connection between the tip and the stem. In this embodiment the contact between the stem and the soil is reduced or prevented by the use of a protective sleeve or shield which is removed after the pile has been driven.

More specifically, FIGS. 20–22 are cross-sectional views, in elevation, broken away, taken at different levels along the length of the pile and mandrel. FIG. 20 shows the top of a protective sleeve and the upper portion of the mandrel. FIG. 21 is taken at an intermediate level, and shows the relationship of protective sleeve, stem and mandrel. FIG. 22 shows the tip with the bottom of the mandrel within its socket and the protective sleeve resting on top of the tip. In the specific embodiment illustrated in the drawings the protective sleeve is a tube 101 (such as a heavy steel pipe) of about the same length as the corrugated stem 102. The mandrel comprises a heavy steel pipe 103, at whose lower end is a plate 104 resting on the base 106 of the socket 107 of the tip 108. The plate 104 may be welded or otherwise secured to the pipe 103. The top (not shown) of the mandrel receives the pile driving blows which are transmitted through it to the base of the socket. The tube 101 rests on the top of the tip and moves downward, under its own weight, as the tip is driven downward. The arrangement also includes means for supplementing the force of gravity on the tube 101 when the friction between it and the soil prevents it from following the tip closely. Thus the upper portion of the mandrel, which portion usually remains above ground throughout the driving, may have a shoulder, such as collar 109, positioned to engage the top of the tube 101 when the tube lags appreciably behind the tip; the downward movement of the mandrel will then also force the tube 101 downwards. For instance the position of the collar, in relation to the length of the tube 101, may be such that the collar makes contact with the top of the tube when the top of the tip has been moved some 0.1 to 3 feet below the bottom of the tube 101. The collar may be welded or bolted to pipe 103.

In operation, the tip may be placed with its base on the ground at the location where the pile is to be driven, the long stem 102 may then be attached to the tip, after which the long tube 101 may be fitted over the stem and the mandrel lowered into the stem with its base resting on the bottom of the socket of the tip. The pile is then driven by the hammer acting on the exposed top of the mandrel until, say, the resistance criterion for the design load has been attained; then the mandrel is withdrawn and the tube 101 (which has aperture lugs 11 for that purpose) is pulled out of the ground. The concrete may be poured into the stem after the tube 101 has been removed, but it is also within that broader scope of the invention although usually less desirable, to remove the tube after the stem has been filled with concrete.

The tube 101 may be of such construction that it can move smoothly through the ground and can also withstand those forces, exerted on it at times by the mandrel, that may be necessary to overcome friction with the ground. For example, it may be a smooth surfaced heavy steel pipe having a substantially uniform internal diameter slightly greater (e.g. about 1 to 6 inches greater) than the outside diameter of the corrugated stem.

It is understood that the foregoing detailed description is given merely by way of illustration and that variations may be made therein without departing from the spirit of the invention. The "Abstract" given above is merely for the convenience of technical searchers and is not to be given any weight with respect to the scope of the invention.

I claim:

1. A tip for a pile having a tubular metal stem, which stem is filled with concrete after the pile is driven, said tip being of reinforced concrete and having an upper central cavity adapted to receive said filling of concrete, said tip being tapered to increase in diameter from the bottom upwards, the maximum cross-sectional area of the tip being about 5 to 15 times the cross-sectional area of the stem, the taper being less than about 3 inches per foot and the axial height of said tip being at least about 2 feet, and in which said tip has an upper central tubular liner rigidly embedded in the concrete of said tip and to which the stem is adapted to be attached before said pile is driven.

2. A tip as in claim 1 in which said liner is a short length of corrugated metal shell and said cavity is of sufficient size to house a driving mandrel whereby the force of the pile driving hammer is transmitted to the bottom of said cavity.

3. A tip as in claim 1 in which said liner is a short length of pipe of sufficient strength to transmit pile driving forces to said tip from a connected length of pipe piling serving as the stem of said pile.

4. A tip as in claim 1, of substantially circular cross-section.

5. A tip for a pile having a tubular metal stem, which stem is filled with concrete after the pile is driven, said tip being of reinforced concrete and having an upper central cavity adapted to receive said filling of concrete, said tip being tapered to increase in diameter from the bottom upwards, the maximum cross-sectional area of the tip being about 5 to 15 times the cross-sectional area of the stem, the taper being less than about 3 inches per foot and the axial height of said tip being at least about 2 feet and in which the base of said tip has a diameter of at least 8 inches, the axial height of said tip is at least 2 feet and at least 1 foot greater than the depth of said cavity, the depth of said cavity being about 0.4 to 0.6 times said axial height.

* * * * *